US005099953A

United States Patent [19]

Stegath

[11] Patent Number: 5,099,953

[45] Date of Patent: Mar. 31, 1992

[54] FOLDABLE SCAFFOLD

[75] Inventor: Murray C. Stegath, Weyauwega, Wis.

[73] Assignee: Staghorn Products, Waupaca, Wis.

[21] Appl. No.: 549,505

[22] Filed: Jul. 6, 1990

[51] Int. Cl.[5] ..... E04G 1/00
[52] U.S. Cl. ..... 182/152; 182/230
[58] Field of Search ..... 182/152, 118, 119, 137, 182/123, 113, 230

[56] References Cited

U.S. PATENT DOCUMENTS

| | | | |
|---|---|---|---|
| 2,852,145 | 9/1958 | Scholz | 182/152 |
| 3,011,586 | 12/1961 | Harvey, Jr. | 182/152 X |
| 3,221,837 | 12/1965 | Fisher | 182/152 X |
| 3,266,503 | 8/1966 | Hoiness et al. | 182/152 X |
| 3,392,801 | 7/1968 | Gethmann | 182/118 X |
| 3,747,898 | 7/1973 | Warren | 182/113 X |
| 4,155,424 | 5/1979 | Johnson | 182/152 X |
| 4,534,447 | 8/1985 | Champigny | 182/152 |
| 4,609,071 | 9/1986 | Edwards | 182/118 X |

FOREIGN PATENT DOCUMENTS

| | | | |
|---|---|---|---|
| 2056545 | 3/1981 | United Kingdom | 182/113 |

OTHER PUBLICATIONS

Genie Industries, "Genie Quik-Step", Jun. 1984.

*Primary Examiner*—Karen J. Chotkowski
*Attorney, Agent, or Firm*—McDermott, Will & Emery

[57] ABSTRACT

A foldable scaffold includes a frame and one or more planks for supporting one or more workmen. The frame comprises two generally vertically extending end ladders and a horizontally extending truss portion. The truss portion includes three pivotally connected elements to permit collapsing or folding of the scaffold for ease in transportation to a job site. The truss portion includes two, similar truss end members that are pivotally connected to the end ladders and a central locking gate element. The locking gate is pivotally connected to the inner ends of the two truss end portions and includes means for locking the central gate and end portion in a straight horizontal position to maintain the truss in a fully extended position. A plurality of connectors permit vertical stacking of one or more of the foldable scaffolds and the workmen's supporting planks are removably mounted to the tops of the end ladders when the truss portion is in its fully extended, locked position. A plurality of casters are provided to facilitate movement and positioning of the extended scaffold.

15 Claims, 3 Drawing Sheets

38
40
18
34
22
42
36
30
26
46
44
24
28
36
30
42
40

34
46
54
70
60
62
72
54
52
76
74
50
64
42

54
34
56
F
74
60

FOLDABLE SCAFFOLD

BACKGROUND OF THE INVENTION

1. Field of the Invention

This invention relates to scaffolds and, in particular, foldable scaffolds.

2. Prior Art

The presently available scaffolds generally comprise ladder sections assembled by connecting the ladder portions with pins or bolts to horizontal bracing elements. These scaffolds take a considerable amount of time to assemble and substantial space during transport to the job site. In addition, once assembled, the prior art scaffolds are cumbersome to move.

OBJECTS OF THE PRESENT INVENTION

One of the objects of the present invention is to provide a scaffold to permit transport in a compact manner without sacrificing overall rigidity of the fully extended scaffold.

Another object of the present invention is to provide a scaffold wherein the scaffold frame is made of permanently connected parts.

A further object of the present invention is to provide a scaffold wherein the workmen's supporting planks are securely connected to the ladder steps to maintain the end ladders in a spaced-apart, parallel orientation.

Another important object of the invention is to provide a scaffold wherein the folded scaffold can be easily stored or transported.

Another object of the present invention is to provide a scaffold with connecting elements so that several frame portions can be mounted one on top of another.

Another object of the present invention is to provide a foldable scaffold that is more than twice as long as the width of the end ladders.

Another object of the present invention is to provide a foldable scaffold which is automatically and conveniently locked when opened to its fully erect position.

Another object of the present invention is to provide a foldable scaffold wherein the locking elements are permanently supported by the scaffold frame.

Another object of the present invention is to provide a foldable scaffold having frames of multiple heights to provide additional user flexibility.

Another object of the present invention is to provide a toeboard supporting mechanism for supporting a vertically oriented toeboard adjacent the workmen's supporting planks for additional safety.

Other objects and advantages of the present invention will become apparent taken in conjuction with the following detailed description.

SUMMARY OF THE INVENTION

The present invention provides a scaffold frame and a workmen's supporting platform for safely supporting a workman in an elevated position.

The scaffold includes a frame having two vertically extending end ladders, a single pivotally mounted truss portion joining the ladders together in a spaced-apart, parallel relationship and having hinge means connecting similar end portions of the truss to the end ladders and a second hinge means for pivotally connecting the inner ends of the truss end portions to a locking central gate portion. The central gate portion includes locking means for securing the locking gate and truss end portions in alignment. A plurality of workmen supporting planks are removably secured to the steps or rungs of the end ladders in a horizontal orientation while maintaining the ladders in a parallel orientation. A safety bar may be used on the uppermost portion of the scaffold. A toeboard support means is also provided to support a vertically oriented toeboard adjacent the exterior edge of the workmen's supporting platform.

BRIEF DESCRIPTION OF THE DRAWINGS

In drawings forming a portion of the disclosure of this invention.

DETAILED DESCRIPTION OF THE PREFERRED EMBODIMENT

Figure 1:
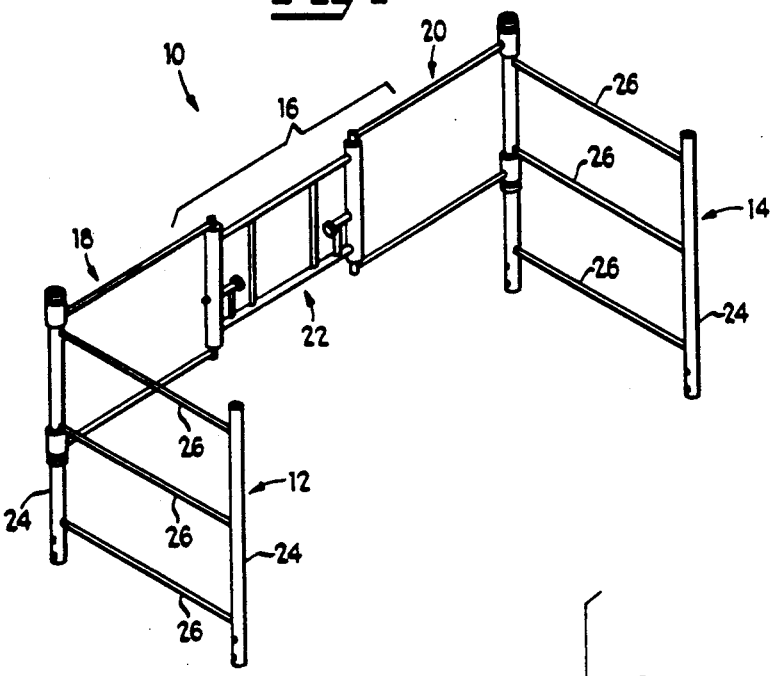
FIG. 1 is a perspective view of an extended or erected scaffold frame made in accordance with the present invention.

Referring to the drawings, and in particular, to FIG. 1, the foldable scaffold, generally designated 10 of the present invention, includes a pair of end ladders 12 and 14 and a truss 16 connecting the end ladders 12 and 14 together. The truss portion 16 has a pair of similarly shaped end members 18 and 20 and a center locking gate portion 22 as will be described in greater detail below. The truss end members 18 and 20 are pivotally mounted at their respective outer ends to the end ladders 12 and 14, respectively, and at their respective inner ends to the locking gate 22 to permit folding of the scaffold as shown in FIG. 2.

More particularly, each of the end ladder members 12 and 14 include a pair of vertical posts 24 typically made of hollow cylindrical tubular elements of sufficient length. Preferably, the posts 24 are made of steel but other materials could be used for specific applications. Each ladder includes two posts 24 which are secured to one another in a parallel relationship by a plurality of ladder rungs 26 which are welded at their ends to the posts 24. The pivotal connection of the end portions 18 of the truss member to the ladder posts 24 and the locking gate 22 will be more easily understood with reference to FIG. 4. In particular, the end portions 18 and 20 are mirror images of one another and like numerals will be used to reference like parts. The end portion 18 has a pair of horizontal tubular elements 30 which are secured to a vertical tubular element 34 on the inner end and a pair of sleeves or collars 36 on the outer end. FIG. 1 shows the "safety cage" portion which is approximately 3' in height and designed to be used only as the top portion of an assembled scaffold. To prevent stacking on the "safety cage", a cap 38 is provided on top of each post 24.

Each journal or collar 36 is of suitable length to maintain rigidity and includes an open, inner diameter which is slightly larger than the outside diameter of the ladder posts 24. Preferably, the horizontal members 30 are welded to the journal 36 and the vertical member 34 for added rigidity. The journal portions 36 are captured on their top and bottom sides by a collar 40 which is welded or otherwise connected to the ladder posts in a spaced-apart relationship such that the vertical spacing between the horizontal elements 30 span at least two of the ladder rungs 26. This construction permits the end members 18 and 20 to pivot through an angle of approximately 350+ degrees relative to the respective end ladders 12 and 14. The vertical posts 34 at the inner end of each of the members 18 and 20 are connected together by the locking gate 22 as previously described. The locking gate includes a pair of horizontal posts 42 and vertical posts 44. The vertical posts 44 are connected such as by suitable welding methods to the horizontal posts 42. The ends of the horizontal posts 42 are each welded to a vertical collar 46. The collar or sleeve 46 includes an internal diameter which is slightly larger than the outside diameter of the vertical posts 34 to provide a pivotal connection between each end member and the locking gate 22. Thus, the truss portion comprises two end portions 18 and 20 which are pivotally connected to the vertical posts 24 of the respective end ladders 12 and 14. The inner ends of the end members 18 and 20 are also pivotally connected to the locking gate portion 22. The pivotal connection permits the scaffolding frame to be collapsed as shown in FIG. 2.

Figure 2:
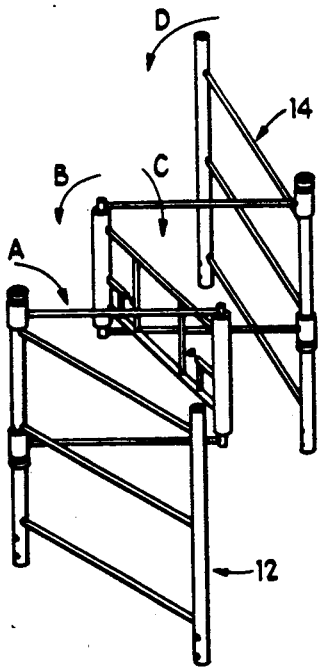
FIG. 2 is a perspective view of the scaffold of FIG. 1 illustrating the manner in which the scaffold can be collapsed or folded.

Referring to FIG. 2, and with reference to FIG. 1, it can be seen that the left end ladder portion 12 remains in the same position as the gate 18 has been pivoted in a generally clockwise direction such as that shown by arrow A while the locking gate 22 has been pivoted in a generally counterclockwise direction as shown by arrow B. Concurrently, the left end portion 20 is pivoted generally in a clockwise direction as shown by arrow C while the opposite end ladder 14 has been pivoted in a generally counterclockwise direction to an angle of approximately 180° in the direction as shown by arrow D. In this manner, the complete scaffold can be folded in a zigzag fashion in a relatively compact grouping. Also, because the foldable or collapsible truss portion 16 is made of three pivotal elements, the width of the assembled scaffold can be substantially larger than the width of any of the truss elements and there will be no extension of the truss elements outside the perimeter of the end ladders 12 and 14 when in the folded position. This was a major drawback in all prior proposed foldable scaffolds, particularly those which had only one pivot point or break in the truss portion such as that shown in Champigny, U.S. Pat. No. 4,534,447.

Figure 4:
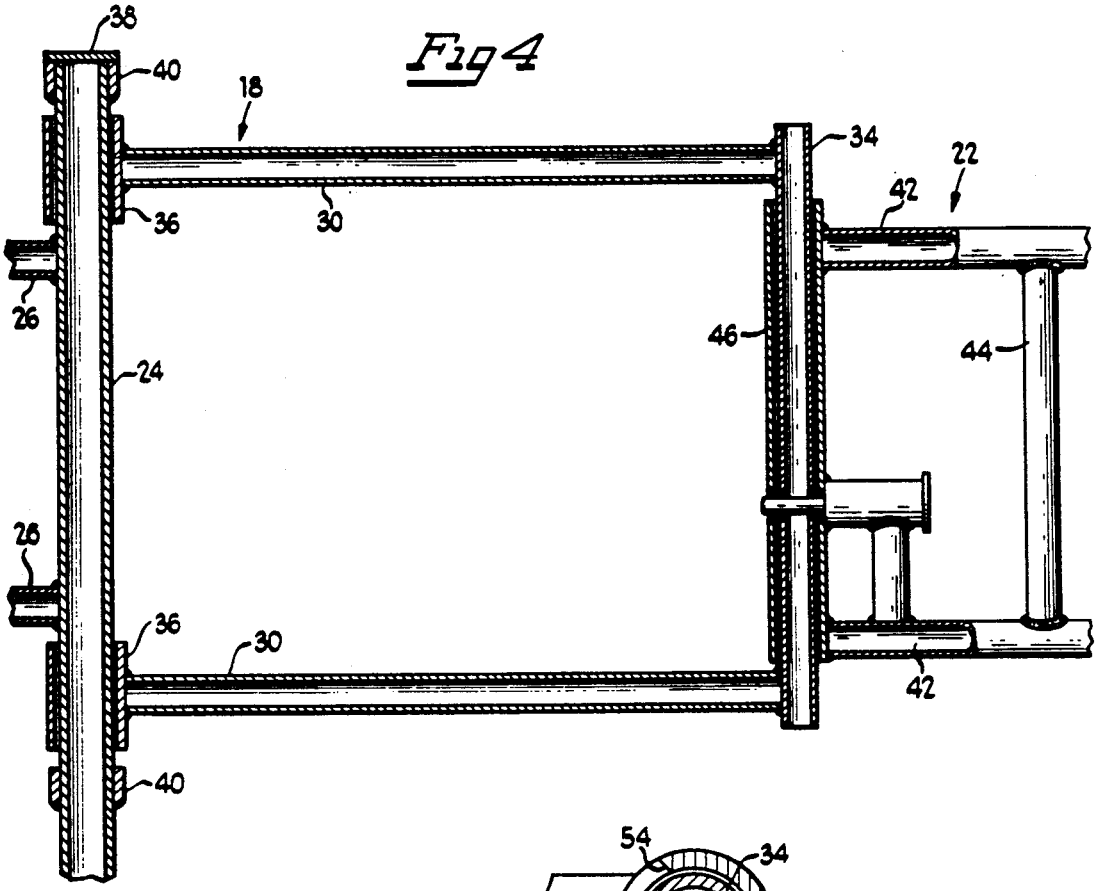
FIG. 4 is a fragmented vertical section through the locking means of the foldable scaffold of the present invention.
Figure 5:
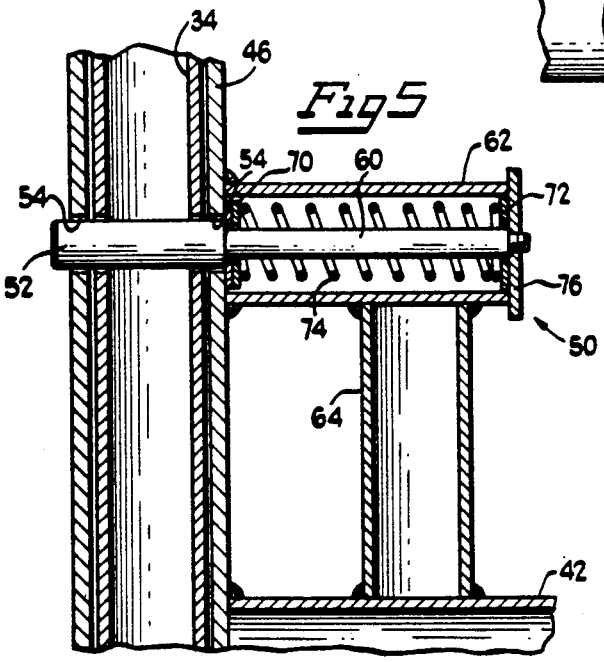
FIG. 5 is an enlarged vertical section showing the locking pin in its locked position.
Figure 6:
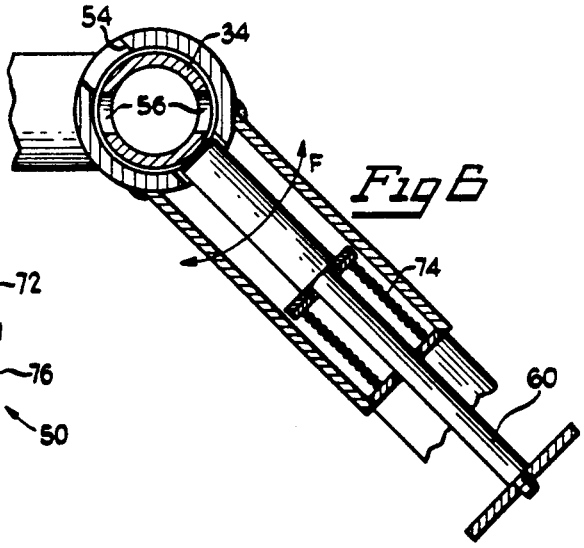
FIG. 6 is a horizontal section through the locking means showing the locking pin in its unlocked position.

The locking gate 22 includes a locking means to secure the end members 18 and 20 in alignment with the gate 22. In particular, referring to FIG. 5, the locking gate 22 includes a pair of spring-biased locking means, generally designated 50. The locking means 50 includes a spring-biased locking pin 52 which is passed through a pair of apertures 54 on the collar 46 and a pair of apertures 56 on the vertical post element 34 of the adjacent truss end member 18 or 22. When fully extended, the locking pin 42 passes through the aligned apertures 54 and 52 to securely lock the locking gate 22 in alignment with each of the truss end members 18 and 20. The locking means 50 is permanently attached to the frame and spring biased to operate automatically preventing the loss of pins or inadvertent failure of a user to properly lock or connect the scaffold in an open position. More particularly, the locking pin 52 includes a reduced diameter shaft 60 extending through a generally horizontal cylinder 62 which is connected to both the journal 46 and the horizontal member 42 by a tubular strut 64. The shaft 60 carries a stop 70 adjacent the enlarged pin 62 at one end and a second stop 72 which is a cap at the righthand end of the cylindrical portion 62 in FIG. 5. A coil spring 74 is provided on the shaft 60 between the stop 70 and stop 72 to constantly bias or urge the locking pin 52 into the aligned apertures 54 and 56. Referring to FIG. 6, it can be seen that a handle 76 is provided on the end of the shaft 60 to pull the pin against the bias of the spring 74 so that the locking pin 52 clears the apertures 56 and permits relative rotation of the locking gate 22 in both directions as shown by arrow F in FIG. 6. The locking gate 22 cannot be rotated completely adjacent either of the end truss members 18 or 20 so that the locking pin can only engage and lock the gate in the open or aligned position as shown in FIGS. 4 and 5. However, extracting the pins from their locking position to the release position as shown in FIG. 6, permits the scaffolding to be easily folded for storage and transport.

Figure 3:
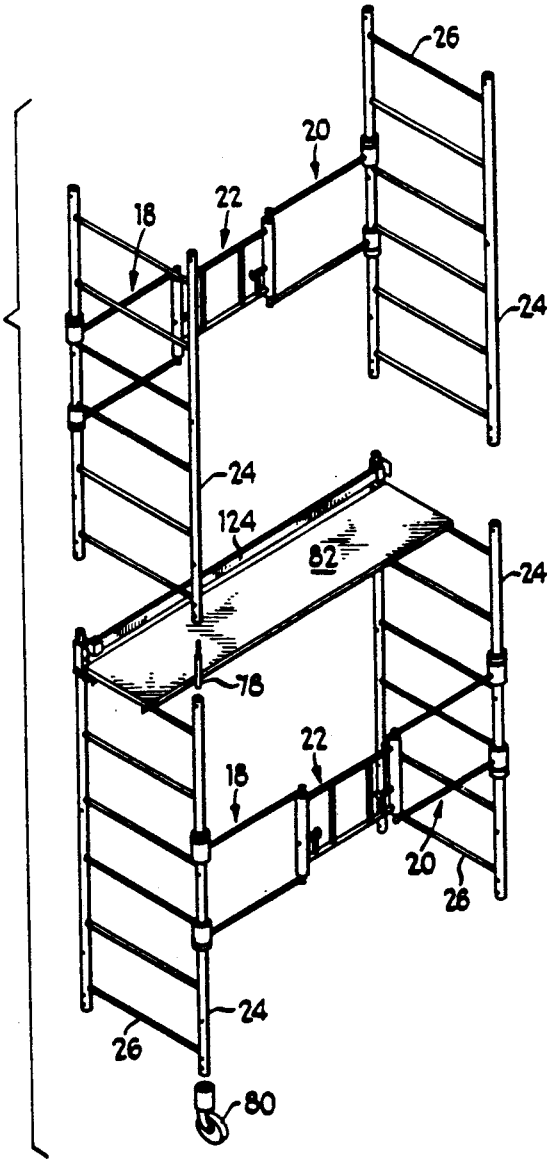
FIG. 3 is another perspective view of two scaffold frames made in accordance with the present invention illustrating the stackability.

FIG. 3 shows several other elements of the present invention. Referring to FIG. 3, each of the end ladders are lengthened to include six rungs with the truss portion 16 mounted halfway along the vertical length of the end ladders. Obviously, the end ladders could be longer but some rigidity is lost with additional lengthening of the end ladders. Alternatively, it is preferable to use a pair of folding scaffold frames which can be mounted on top of one another by the use of connecting pins 78. The pins 78 are preferably secured within the posts 24 but may be removable. Four connecting pins would be used, for example, to connect one folding scaffold to another. Also, in many instances, it is preferable to provide a plurality of casters 80 on the bottom or lowermost scaffold frame for easy movement of the scaffold which is primarily intended for indoor use.

It is contemplated that any combination of small and large scaffold frames can be combined but the upper scaffold or "safety frame", as shown in FIG. 1, is generally intended to be the topmost frame in any combination since a normal workman would have a height sufficient to reach over the top of the top rungs of the ladders and the truss.

Figure 7:
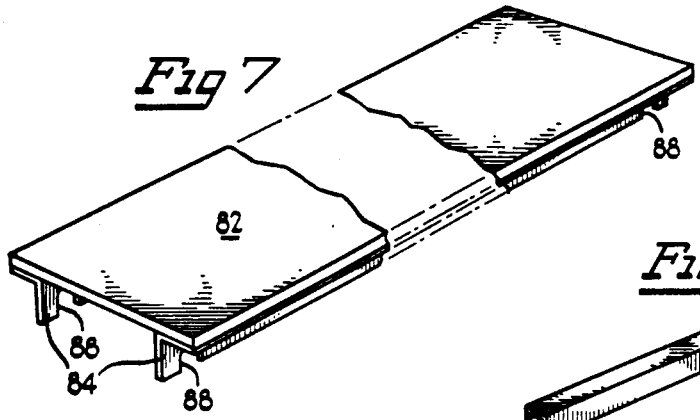
FIG. 7 is a perspective view of one of the workmen's supporting planks of the present invention.

FIG. 7 shows a suitable workmen's platform or plank 82 which spans the rungs 26 of the desired end ladder element. Each plank 82 is strengthened by a pair of angle iron members 84 mounted on the bottom side of the plank. The downwardly projecting portion of the angle iron elements each include a slot 88 at each end which rests on a suitably sized ladder rung 26. In this manner, the planks 82 add additional rigidity and strength to the open or erected scaffold frame. Preferably the planks 82 are half as wide as the spacing between the vertical posts 24 of the end ladders so that two planks 82 can be used for a full platform and provide multiple points of contact for additional rigidity.

Figure 8:
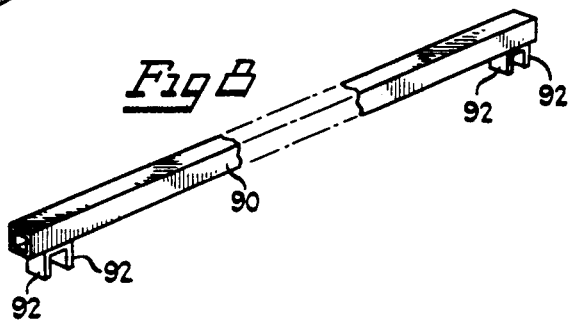
FIG. 8 is a perspective view of a safety bar made in accordance with the concepts of the present invention.

When several foldable scaffolds are mounted one on top of the other, it is desirable that an upper or top scaffold portion, such as that shown in FIG. 1, be used to provide a "fence" above the uppermost planks. In this case, a safety rail 90 such as that shown in FIG. 8, is preferably used. The safety rail 90 is formed of hollow, square or tubular material and includes a pair of depending tabs or flanges 92 on each end. The pair of flanges 92 at each end of the safety rail 90 are designed to encapsulate the topmost rung 26 to provide a guard rail as well as adding additional rigidity to the uppermost "fence" scaffold. Obviously, in most instances, it would not be practical to use a plank 82 at this location, although it may be desirable in the event additional, waist-high working surface is required as when used as a single small frame scaffold.

Figure 9:
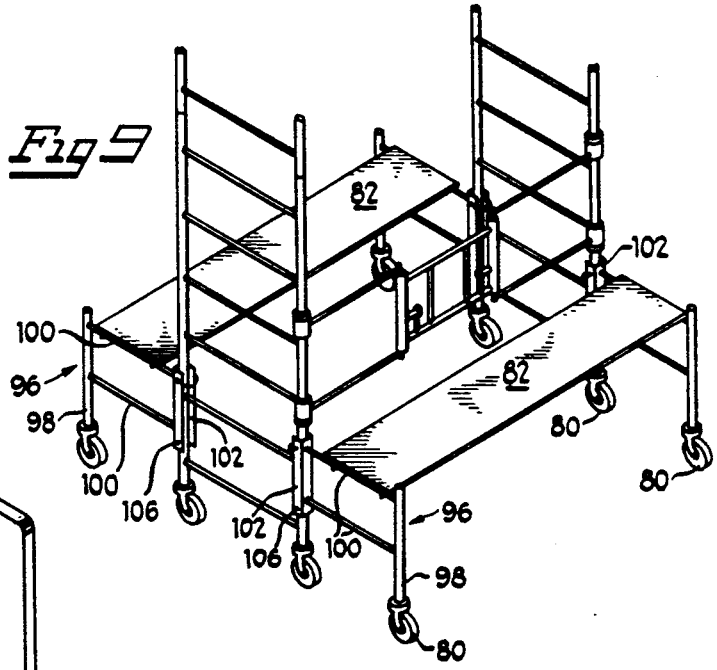
FIG. 9 is a perspective view of the scaffold showing the stabilizers made in accordance with the concepts of the present invention.

Referring to FIG. 9, when two or more of the folding scaffold frames are mounted on top of one another, it is often desirable to use one or a pair of outriggers or stabilizers at the lowermost, ground level scaffold for additional safety. In this instance, each outrigger, generally designated 96, includes a pair of end elements with a vertical wheeled post 98, a pair of horizontal bars 100 and a vertical U-shaped channel 102. The U-shaped channel 102 includes a pair of spaced-apart apertures 104 which are adapted to receive a pair of pins 106 which are passed through mating apertures in the vertical posts 24 of the scaffold ladder ends. A similar pair of planks 82 spanning the uppermost rungs 100 maintain the outriggers in their orthogonal orientations.

Figure 10:
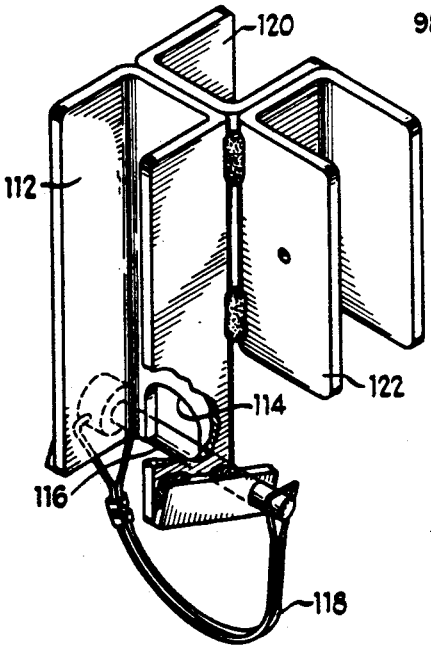
FIG. 10 is a perspective view of the toeboard holding means made in accordance with the concepts of the present invention.

The present invention also includes a toeboard holding means, generally designated 110 in FIG. 10. The toeboard holding means is designed to hold a 2×4 in a generally vertical orientation adjacent the perimeter edges of the planks 82 in a position known as a "toeboard". The toeboard holder 110 includes three similarly shaped sections of U-channel, typically made of steel or the like, and welded together in the configuration as shown in FIG. 10. The toeboard holder includes a base channel portion 112 which surrounds the upper end of a ladder post 24 so that the arcuate cutout portion 114 engages the top rung 26 permitting a pin 116 under the rung 24 to secure the base 112 adjacent the post 24. A spring clip or wire 118 around the exterior of the post 24 secures the pin in place. A pair of toeboard support channels 120 and 122 are welded to the base 112 as shown such that when the toeboard mounting means is in place, a properly sized 2×4, 124 can be slipped into aligned channels 120 and 122 to provide a raised perimeter, commonly known as a toeboard or toestop, adjacent the outer edges of the planks 82 on the scaffold (see FIG. 3). In this manner, the workmen will have a physical indication as a safety feature to prevent falling off or over the edge of the scaffolding platform.

The foregoing detailed description has been given for clearness of understanding only and no unnecessary limitations should be understood therefrom as some modifications of the folding scaffold described herein will be obvious to those skilled in the art.

What is claimed is:

1. A foldable scaffold comprising two end ladders, each including a pair of legs and a plurality of rungs extending between said legs, a truss member including a plurality of pivotally connected members between the legs of the two ladders, said truss member including at least two outer elements pivotally connected to the respective ladder legs and at least one inner element pivotally connected to the two outer elements to permit alignment of the outer elements in an orthogonal relationship relative to the two end ladders and locking means on said elements for securing the plurality of elements in an aligned truss position in which the elements are in end-to-end alignment while maintaining the end ladders in a spaced-apart vertical alignment.

2. The folding scaffold of claim 1 wherein said locking means comprises at least one spring-biased locking device which locks the elements of the truss member in alignment automatically upon pivotal movement to said aligned position.

3. The folding scaffold of claim 2 wherein said locking device includes a spring-biased plunger which engages aligned apertures when the pivotally connected members are properly aligned.

4. The folding scaffold of claim 3 wherein the elements of the truss member includes a pair of end members pivotally connected to the legs of the respective end ladders and a central locking gate portion pivotally connected to the inner end of the end members and a pair of spring-biased locking means on the locking gate member for automatically, releasably locking the elements in end to end alignment.

5. The folding scaffold of claim 4 wherein each locking means includes a spring-biased locking pin for engaging aligned apertures at the pivotal connection points.

6. A foldable scaffold comprising two end ladders, each including a pair of posts and a plurality of rungs extending between said posts, a truss member including three pivotally connected members between the two ladders including two outer elements pivotally connected to the respective ladder posts and at least one inner element pivotally connected to the two outer truss elements to permit alignment of the pivotally connected members in an orthogonal relationship relative to the two end ladders and locking means on said truss member for securing the elements in an aligned position in which the elements are in end-to-end alignment while maintaining the end ladders in a spaced-apart vertical alignment.

7. The folding scaffold of claim 6 wherein said locking means comprises at least one spring-biased locking device which locks the three pivotally connected members of the truss member in alignment automatically upon pivotal movement to said aligned position.

8. The folding scaffold of claim 7 wherein said locking device includes a spring-biased plunger which engages aligned apertures when the respective pivotally connected members are properly aligned.

9. The folding scaffold of claim 8 wherein the truss member includes a pair of spring-biased locking means for automatically, releasably locking the three pivotally connected members in end-to-end alignment.

10. The folding scaffold of claim 9 wherein each locking means includes a spring-biased locking pin for engaging aligned apertures at the pivotal connection points.

11. A foldable, stackable scaffold comprising two end ladders, each including a pair of legs and a plurality of rungs secured between said legs, a truss member including a plurality of pivotally connected members between the legs of the two ladders, said truss members including at least two outer elements pivotally connected to the respective ladder legs and at least one inner element pivotally connected to the inner, free ends of the outer elements to permit alignment of the elements in an orthogonal relationship relative to the two end ladders, locking means on said truss member for securing the plurality of elements in end-to-end alignment while maintaining the end ladders in a spaced-apart vertical alignment, at least one support plank for mounting between the rungs of the end ladders and means for holding a toeboard between said end ladders.

12. The scaffold of claim 11 wherein said locking means comprises at least one spring-biased locking device which locks the elements of the truss in alignment automatically upon pivotal movement to an aligned position.

13. The scaffold of claim 12 wherein said locking device includes a spring-biased plunger which engages aligned apertures when the pivotally connected members are properly aligned.

14. The scaffold of claim 13 wherein the toeboard holding means includes mounting means for connection to one of the ladders and an integral slot for supporting a toeboard in a generally vertical orientation adjacent the outer edge of the support plank.

15. The scaffold of claim 14 wherein said spring-biased plunger includes a spring-biased locking pin for engaging said aligned apertures.

* * * * *